United States Patent [19]

Allenbaugh, Jr.

[11] Patent Number: 4,469,279

[45] Date of Patent: Sep. 4, 1984

[54] CONSTANT PRESSURE NOZZLE WITH SELECTIVE VOLUME LIMIT CONTROL

[75] Inventor: George G. Allenbaugh, Jr., Wadsworth, Ohio

[73] Assignee: Premier Industrial Corporation, Cleveland, Ohio

[21] Appl. No.: 412,574

[22] Filed: Aug. 30, 1982

[51] Int. Cl.[3] ..... B05B 1/32

[52] U.S. Cl. ..... 239/453; 239/459

[58] Field of Search ..... 239/452, 453, 456–460, 239/533.1, 570

[56] References Cited

U.S. PATENT DOCUMENTS 2,554,409 5/1951 Holder ..... 239/452
2,753,219 7/1956 Matarese ..... 239/456
3,508,711 4/1970 Switall ..... 239/570
4,289,277 9/1981 Allenbaugh ..... 239/459 X

*Primary Examiner*—Andres Kashnikow
*Attorney, Agent, or Firm*—Isler and Ornstein

[57] ABSTRACT

A constant pressure discharge nozzle having a pressure-responsive baffle head assembly for varying the size of the discharge opening in response to fluid pressure in the nozzle, and having adjustable stop means, controlled from the exterior of the nozzle, for limiting the pressure-responsive opening movement of the baffle head to selected positions intermediate the minimum and maximum pressure-responsive positions, while still permitting pressure-responsive movement of the baffle head between a selected intermediate position and the minimum flow position.

16 Claims, 3 Drawing Figures

CONSTANT PRESSURE NOZZLE WITH SELECTIVE VOLUME LIMIT CONTROL

BACKGROUND OF THE INVENTION

The invention relates to means for selectively overriding the pressure-responsive operative range of a constant-pressure fluid discharge nozzle, such as used in fire fighting.

Such constant-pressure fluid discharge nozzles are structured to maintain a substantially uniform reach of the fluid discharge stream by maintaining a constant fluid discharge pressure, within the operative gallonage range of the nozzle, despite variations in the supply pressure or supply volume of fluid, which may occur for various reasons.

Examples of such constant pressure nozzles can be found in Allenbaugh, U.S. Pat. Nos. 3,904,125; 4,172,559 and 4,289,277; McMillan, U.S. Pat. No. 3,863,844, and Burnam et al, U.S. Pat. No. 2,568,429.

All of these prior art patents use a yieldably-mounted pressure-responsive baffle to progressively enlarge the nozzle discharge orifice or opening as fluid pressure or volume in the nozzle increases. The enlargement of the orifice permits a greater volume of fluid discharge to relieve the increased pressure in the nozzle and thereby maintain constancy of discharge pressure and, correspondingly, a uniform reach of stream.

During operation of the nozzle, the baffle may move from a minimum flow position to a maximum flow position, as defined by the length of permissible longitudinal displacement or stroke of the baffle assembly in the specific nozzle structure. Within these limits, the baffle is free to move in response to fluid pressure fluctuations and hunt for an equilibrium position for maintaining uniformity of fluid discharge pressure. The prior art constant-pressure nozzles are not intended to and do not provide any means for selectively fixing the orifice opening at selected gallonage positions. There are prior art fixed gallonage nozzle structures which utilize some means, usually manual rotation of the nozzle sleeve, to selectively enlarge or reduce the size of the orifice to control discharge flow.

There are, however, circumstances where the wholly automatic flow control characteristic of the constant-pressure nozzle creates undesirable consequences. For example, every nozzle operator has to fight the reaction of the nozzle, particularly at flows of 100 g.p.m. and more, when two operators are often required. This reaction force is based upon a formula of volume times the square root of the fluid pressure. Therefore, an abrupt increase in pump supply pressure to the nozzle results in significantly increased volume and suddenly increased reaction force at the nozzle, which a single operator may be unable to handle or control.

Such an abrupt increase in supply pressure may occur, for example, when there are several hose lines in use and, without warning, some are shut down, thus diverting greater flow pressures and volumes to the remaining line or lines, each of which were readily controlled by a single nozzle operator when all the lines were being used. The sudden increase in the nozzle reaction force could cause the operator to lose control of the nozzle at a critical time in the fire-fighting operation, and could even cause injury to the operator before assistance could arrive.

When using an adjustable fixed gallonage type of nozzle, an operator can adjust the orifice to a gallonage setting which he can handle safely, and not fear a sudden increase in reaction force. In the constant-pressure type of nozzle, the operator does not have this option, and is vulnerable to sudden reaction force increases.

SUMMARY OF THE INVENTION

In view of the foregoing, it is a primary object of the invention to provide a constant-pressure nozzle with convenient and easily accessible means for adjusting the operative range of the nozzle to an intermediate gallonage position less than its maximum flow position, at the option of the operator.

Another object of the invention is to accomplish the foregoing adjustability of a constant-pressure nozzle while still maintaining constant-pressure modulation for uniform reach of stream within the range of operating limit which has been adjustably selected by the operator.

Still another object of the invention is to utilize the above-recited adjusting means for conveniently establishing a flushing position for the nozzle, to flush out accumulated debris from the orifice, without the necessity of shutting off the nozzle for dissassembly or otherwise interrupting fluid flow through the nozzle.

To accomplish the foregoing objectives, an adjustable abutment or stop is interposed in the path of pressure-responsive opening movement of the baffle head assembly of a constant-pressure nozzle and control means are provided exteriorly of the nozzle body for selectively interposing said stop means into the path of movement of the baffle head assembly.

Other objects and advantages of the invention will become apparent during the course of the following description and with reference to the following drawings, in which like numerals are used to designate like parts throughout the same.

DESCRIPTION OF THE PREFERRED EMBODIMENTS

Figure 1:
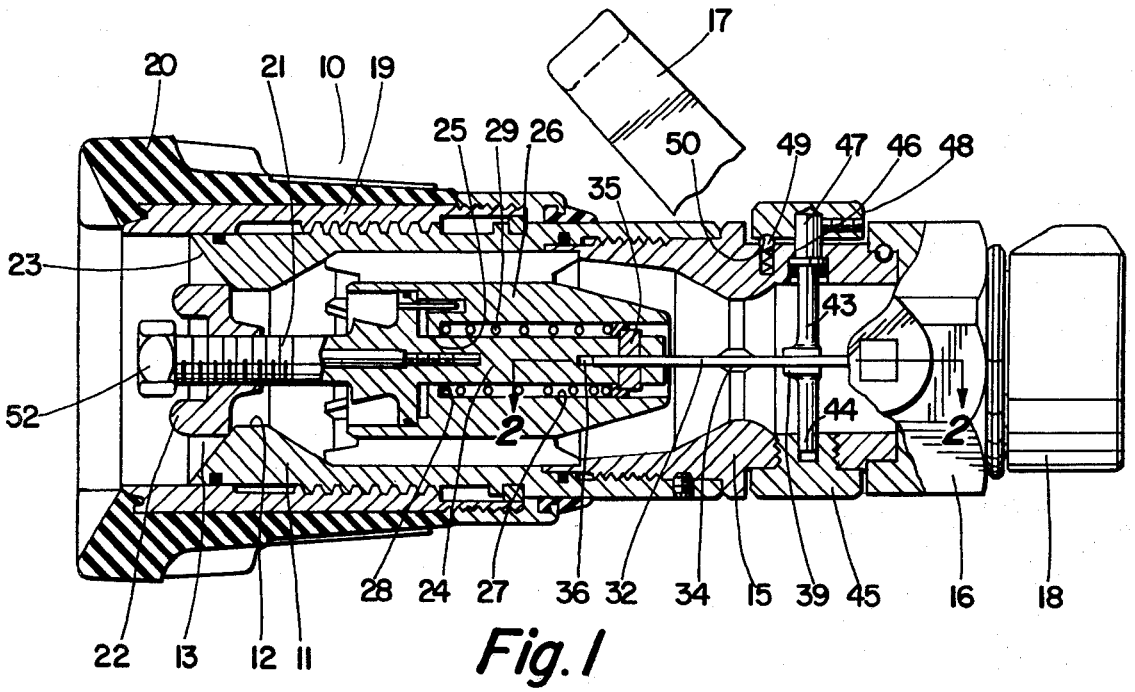
FIG. 1 is a longitudinal cross-sectional view of a representative form of spring-loaded constant-pressure nozzle embodying the features of the invention.

Referring to FIG. 1 of the drawings, there is shown a representative form of constant-pressure nozzle 10 of the type whose basic structure and operation are fully described in the previously-mentioned U.S. Pat. No. 4,172,559, to which reference is made for a detailed description.

The nozzle 10 has a substantially cylindrical hollow body 11 which presents a constricted discharge orifice 12 leading to a conically divergent throat or discharge opening 13. The upstream end 14 of the nozzle body is threadedly secured to a nozzle base 15 which is connected to a shut-off assembly 16 provided with a valve operating handle 17 and a hose connection coupling 18. Rotatably mounted on the exterior of the nozzle body 11, adjacent its discharge end, is an adjustable pattern sleeve 19 having a rubber bumper 20 molded thereon.

Rotation of the sleeve 19 causes changes in the discharge stream pattern from straight stream to fog spray.

The area or size of the discharge opening is controlled by a baffle head assembly 21, which includes a baffle head 22 overlying the discharge orifice 12 and movable toward and away from the angularly-disposed surface 23 of the throat 13. The assembly 21 also includes a baffle stem 24 which slidably projects longitudinally through a central bore 25 in a spindle 26 fixedly mounted within and centrally of the upstream end of the nozzle body 11.

The spindle 26 is counterbored as at 27 to provide an inwardly-directed shoulder 28 adjacent the bore 25. A compression coil spring 29 encircles the stem 24 within the counterbore 27 and has one end thereof seated on the annular shoulder 28. The other end of the spring 29 seats on a gland 30 which is secured to the end of the stem 24 adjacent a shoulder 31 provided on a stem follower 32. The spring urges the baffle head assembly 21 to the right, as viewed in FIG. 1, so as to bring it into a minimum flow discharge position. As shown, the baffle head 22 abuts the surface 23 so that this closed position defines the minimum flow position. But, the minimum flow position of the baffle head need not be the fully closed position illustrated, but could be a position where the baffle head is maintained away from the surface 23 to permit discharge flow. As disclosed in U.S. Pat. No. 4,172,559, the spring 29 is calibrated to permit pressure-responsive displacement of the baffle head 22 in opposition to the spring in response to fluid pressure in the nozzle body, so as to maintain a constant fluid discharge pressure at the discharge opening 13 as the supply pressure fluctuates.

Figure 2:
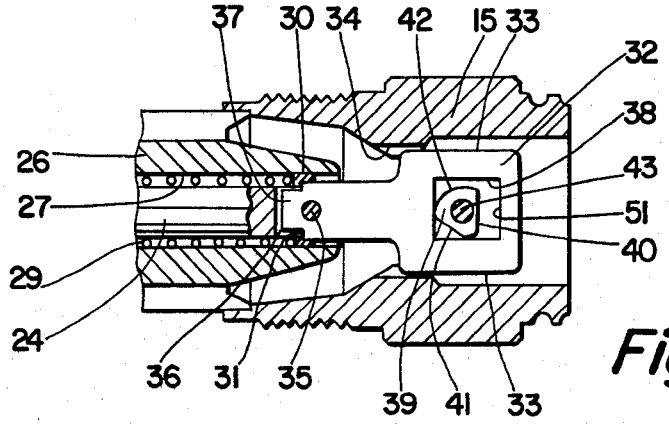
FIG. 2 is an enlarged fragmentary cross-sectional view, taken as indicated on line 2—2 of FIG. 1, showing the position of certain components with the baffle head assembly in its closed or minimum flow position.

As best seen in FIGS. 1 and 2 of the drawings, in the present invention the stem follower 32 is in the form of a thin strip or blade having parallel longitudinally extending guide edges 33 which are slidably received in recesses 34 provided in the nozzle base 15. The recesses 34 prevent any axial rotation of the stem follower 32 while still permitting longitudinal movement thereof. The stem follower is secured to the end of the stem 24 by a transverse locking pin 35 which traverses a receiving slot 36 provided in the end of the stem for a narrow tongue 37 of the follower 32.

A rectangular opening 38 is provided in the follower 32. The opening 38 accommodates an adjustable abutment or stop means, here shown as a cam 39, provided with a plurality of abutment edges or surfaces 40, 41, and 42, each being at different radial distance from the center of rotation of the cam, as defined by the axis of a cam shaft 43 to which the cam is fixed.

The cam shaft 43 has one end 44 thereof suitably journalled for rotation in the nozzle base 15, as by means of a bearing nut 45 threadedly secured in fluid-tight relationship in the nozzle base. The cam shaft extends transversely of the nozzle base to the opposite side thereof and projects outwardly to the exterior thereof through a fluid-tight sealing bore 46 which permits axial rotation of the cam shaft while retaining it against longitudinal movement.

The external end 47 of the cam shaft 43 has a control knob 48 secured thereon, on which suitable indicia may be provided, as desired, for indicating the several positions of the rotatable cam 39. A spring-biased detent ball 49 is mounted in the nozzle base 15 in engagement with the underside of the knob 48 and can be received in suitably spaced depressions or recesses 50 corresponding to selected cam positions to provide tactile indications of the knob settings.

The follower 32 is an extension of the baffle stem 24 and moves longitudinally therewith as the baffle head 22 responds to fluid pressure variations in opposition to the spring 29. The rear or upstream edge 51 of the opening 38 serves, under certain conditions, as a cam follower for the cam 39 in the manner now to be described.

When the nozzle 10 is not operating, the baffle head assembly 21 is in the minimum flow position, such as the substantially closed position shown in FIGS. 1 and 2. When fluid under pressure is supplied to the nozzle, the baffle head responds to the pressure and moves to the left, as viewed in FIG. 1, to enlarge the discharge opening 13 until there is sufficient volume of discharge to achieve the pre-determined constant discharge pressure. At this point in the operation, the spring 29 has been compressed to a point which opposes further opening movement of the baffle head. If there is a drop in the fluid supply pressure, the baffle head is moved by the spring to constrict the discharge opening and maintain constant discharge pressure. If there is an increase in the fluid supply pressure, the baffle head moves in opposition to the spring to enlarge the discharge opening to maintain a constant discharge pressure.

When the edge 51 of the opening 38 abuts the radially innermost cam edge 40, the baffle head assembly 21 has attained the limit of its stroke, and further pressure-responsive opening movement of the baffle head 22 is prevented. This defines the operative maximum flow position of the baffle head which, for example, could be 200 g.p.m. for a given automatic constant-pressure nozzle. At such flow, it is likely that two operators would be available to handle the nozzle to control its reaction force. If one of these operators was needed elsewhere in the fire-fighting operation, the reaction force might be too much for one operator to handle.

If this circumstance should occur, the remaining operator would rotate the control knob 48 to, for example, the 100 g.p.m. position to bring the radially outermost cam surface 42 into abutment with the edge 51 of opening 38, thus camming the follower 32 and the baffle head assembly 21 rearwardly. The baffle head is prevented from further opening movement beyond this adjusted abutment position, which is intermediate the normal automatic minimum-maximum flow range of the nozzle. However, due to the lost motion connection between the stop means and the baffle head assembly, the baffle head can still be pressure-responsive to constrict the discharge opening further to maintain constant-pressure discharge.

Alternatively, if the operator requires a greater volume of water and can handle the reaction force, he can turn knob 48 to rotate the cam surface 41 into the path of movement of follower edge 51 thereby permitting a greater degree of stroke of the baffle head assembly to enlarge the discharge opening to a flow of 125 or 150 g.p.m., for example.

In either case, the operator can, through use of the conveniently accessible control knob, establish a selected intermediate volume limit of flow through the nozzle, while still retaining the automatic pressure-responsive characteristic below this limit for constant-pressure discharge.

Figure 3:
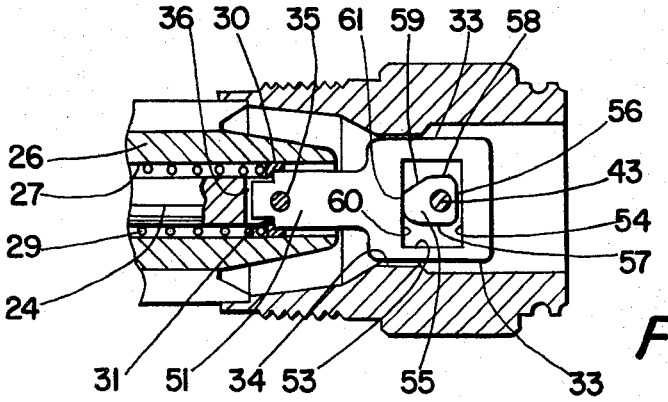
FIG. 3 is a view similar to FIG. 2, but showing a modified form of adjustable stop arrangement for providing a flushing position for the baffle head assembly.

In FIG. 3 of the drawings, there is shown a modified form of the invention adapted to permit flushing of debris from the nozzle without the necessity for stopping water flow through the nozzle.

In prior art constant-pressure nozzles, such as shown in U.S. Pat. No. 4,172,559, the flow of water through the nozzle had to be shut-off in order to clear accumulated foreign matter from the discharge opening. After shut-off, a securing nut 52 was removed to permit removal of the baffle head 22. The water was turned on to flush the debris from the nozzle and then the water was shut off while the baffle head was re-installed.

In the form of invention shown in FIG. 3, the previously described stem follower has been elongated to permit an elongated opening 53 having a follower edge 54. A modified cam 55 is utilized having four camming edges 56, 57, 58, 59. Due to the increased opening stroke of the baffle head assembly permitted by the longer length of the modified opening 53, the cam surface 56 is not utilized during normal operation. The full operative volume limit of the nozzle, say 200 g.p.m., is obtained from the cam edge 57 and the two lower gallonage values from cam edges 58 and 59, in the same manner as was described with reference to cam edges 40–42 of the embodiment of FIG. 2.

The cam edge 56 is utilized only for debris flushing. When the knob is rotated to bring the cam edge 56 into the path of movement of follower edge 54, the baffle head can open sufficiently beyond its normal maximum operative position to flush out the nozzle without interrupting fluid flow through the nozzle. As soon as the momentary flushing operation is completed, the knob 48 is rotated to restore the cam to one of the selected operating flow positions, whereby the baffle head assembly is cammed rearwardly to a more restricted range of stroke.

It will be observed that, instead of relying on the water pressure acting on the baffle head to enlarge the discharge opening for the flush position, it is possible to so arrange and size the cam 55 and the follower opening 53 to provide for the cam surface 61 to act upon the forward edge 60 of the follower opening 53 and positively cam the baffle head assembly forward into flush position independently of possible low water pressure.

It is to be understood that the forms of my invention, herein shown and described, are to be taken as preferred examples of the same, and that various changes in the shape, size and arrangement of the parts may be resorted to without departing from the spirit of the invention or the scope of the subjoined claims.

Having thus described my invention, I claim:

1. In a constant pressure discharge nozzle having an automatic pressure-responsive regulating mechanism for discharge flow, the combination of:

a nozzle body having a fluid discharge opening, a pressure-responsive baffle head assembly movably mounted in said body for adjustably controlling the size of said discharge opening in response to fluid pressure in said body, said baffle head assembly including a baffle stem longitudinally movable in said body between a minimum flow position and a maximum flow position of said baffle head assembly, and adjustable stop means selectively engageable with said baffle head assembly during fluid flow for limiting pressure-responsive opening movement of said baffle head assembly to at least one intermediate flow discharge position between said minimum and maximum positions, whereby said baffle head assembly is retained against pressure-responsive opening movement from said selected intermediate position, but is free to move pressure-responsively between said selected intermediate position and said minimum flow position.

2. A combination as defined in claim 1, wherein said adjustable stop means engages said baffle stem portion of said baffle head assembly.

3. A combination as defined in claim 1, wherein said adjustable stop means is engageable with said baffle head assembly to displace said assembly into a selected flow discharge position.

4. A combination as defined in claim 3, including a lost motion connected between said adjustable stop means and said baffle head assembly which permits pressure-responsive movement between said selected intermediate position and said minimum flow position.

5. A combination as defined in claim 1, wherein said adjustable stop means comprises a cam for effecting displacement of said baffle head assembly into a selected flow discharge position.

6. A combination as defined in claim 5, wherein said cam has operative bi-directional rotation.

7. A combination as defined in claim 1, wherein said adjustable stop means has a plurality of discrete abutment portions for selective engagement with said baffle head assembly.

8. A combination as defined in claim 1, wherein said adjustable stop means is a rotary cam engageable with said baffle head assembly to present movement-limiting abutment surfaces thereto.

9. A combination as defined in claim 8, including a cam follower provided on said baffle stem and operatively engageable by said rotary cam to displace said baffle head assembly in opposition to said fluid pressure.

10. A combination as defined in claims 1 or 2 or 3 or 7 or 8 or 9, including control means for selectively adjusting said stop means, and said control means extending exteriorly of said nozzle body for manipulation thereof.

11. A combination as defined in claim 10, wherein said control means comprises a rotatable member, and detent means are provided on said rotatable member to define selected positions of flow discharge opening of said baffle head assembly.

12. A combination as defined in claim 1, wherein said minimum and maximum flow positions define the operative flow range of said discharge nozzle.

13. A combination as defined in claim 1, wherein said maximum flow position defines a flushing position for clearing debris from said nozzle.

14. In a constant pressure discharge nozzle having an automatic pressure-responsive regulating mechanism for discharge flow, the combination of:

a nozzle body having a fluid discharge opening, a pressure-responsive baffle head assembly movably mounted in said body for adjustably controlling the size of said discharge opening in response to fluid pressure in said body, said baffle head assembly including a baffle stem longitudinally movable in said body between a minimum flow position and a maximum flow position of said baffle head assembly, an adjustable stop means operatively engageable with said baffle head assembly to displace it to said maximum flow position, and spring means for returning said baffle head assembly to a pressure-responsive position from said maximum flow position when said stop means is selectively dis-engaged from said baffle head assembly.

15. A combination as defined in claim 14, including a displacing cam mounted for rotation into and out of operative engagement with said baffle head assembly.

16. A combination as defined in claims 14 or 15, wherein said maximum flow position is a position for flushing debris lodged in said discharge opening during pressure-responsive movement of said baffle head assembly.

* * * * *